US005479966A

United States Patent [19]

Tison et al.

[11] Patent Number: 5,479,966

[45] Date of Patent: Jan. 2, 1996

[54] QUICK FILL FUEL CHARGE PROCESS

[75] Inventors: Raymond R. Tison, Mentor; Paul F. Swenson, Shaker Heights, both of Ohio

[73] Assignee: Consolidated Natural Gas Service Company, Inc., Pittsburgh, Pa.

[21] Appl. No.: 97,754

[22] Filed: Jul. 26, 1993

[51] Int. Cl.[6] ..... B65B 31/00; B67C 3/00

[52] U.S. Cl. ..... 141/4; 141/12; 141/18; 141/83

[58] Field of Search ..... 141/1, 2, 4, 5, 141/12, 18, 71, 82, 83, 39, 40

[56] References Cited

U.S. PATENT DOCUMENTS

| | | | |
|---|---|---|---|
| 4,527,600 | 7/1985 | Fisher et al. | 141/4 |
| 4,582,100 | 4/1986 | Poulsen | 141/4 |
| 4,705,082 | 11/1987 | Fanshawe et al. | 141/4 |
| 4,883,099 | 11/1989 | Vanommeren | 141/1 |
| 4,898,217 | 2/1990 | Corbo et al. | 141/83 |
| 4,966,206 | 10/1990 | Baumann et al. | 141/83 |
| 4,987,972 | 1/1991 | Pierson | 141/1 |
| 5,029,622 | 7/1991 | Mutter | 141/4 |
| 5,107,906 | 4/1992 | Swenson et al. | 141/11 |
| 5,238,030 | 8/1993 | Miller et al. | 141/4 |
| 5,247,971 | 9/1993 | Talu | 141/9 |
| 5,259,424 | 11/1993 | Miller et al. | 141/4 |

*Primary Examiner*—Henry J. Recla
*Assistant Examiner*—Steven O. Douglas
*Attorney, Agent, or Firm*—Pearne, Gordon, McCoy & Granger

[57] ABSTRACT

A method and apparatus for fast filling a vehicle fuel tank with high pressure natural gas comprising the steps of coupling a fill line to the vehicle tank, introducing high pressure natural gas into the line and the tank, measuring the pressure in the line in a manner that yields a measurement of the initial pressure of the gas in the tank, assigning an initial temperature for the gas in the tank, predetermining the final desired pressure and temperature of the gas in the tank at the end of the fill, calculating the mass or temperature of the gas to be added to the tank so that the adiabatic compression and potential rise in temperature of gas in the tank is automatically compensated for and the tank is substantially filled with a mass that results in a condition, when the tank and the gas contained therein substantially reach ambient temperature, wherein the pressure in the tank is substantially equal to the nominal rated pressure of the tank and, thereafter filling the tank with the calculated gas mass or temperature.

3 Claims, 14 Drawing Sheets

$$V=\frac{(M3/16)*R*Z*T2}{P2-P1}$$

$$M5=\frac{16*3015*V}{R*Z2*530}$$

Z2 IS ABOUT 0.79

$$T3=\frac{K*P2*T2*T1}{((P2-P1)*T1)+(K*P1*T2)}$$

$$M4=\frac{16*P2*V}{R*Z*T3}$$

QUICK FILL FUEL CHARGE PROCESS

The invention relates to improvements in gaseous tank filling processes.

PRIOR ART

It has long been recognized that when a gas is introduced into a tank from a source of higher pressure, the gas in the tank will increase in temperature. This phenomena is disadvantageous in situations where a pressure tank is desired to be filled to capacity at a relatively high fill rate. In such a case, the length of filling time, ordinarily, is short, typically a few minutes, compared to the time it takes for the tank and its contents to stabilize in terms of temperature through heat transfer to surroundings at ambient temperature requiring typically a few hours. The increased temperature associated with fast filling processes, in turn, results in a corresponding increase in pressure. Thus, if a tank is simply fast-charged to its rated pressure from a source at or near ambient temperature, it will not contain a full pressure charge when the contained gas is allowed to cool to ambient temperature.

This phenomena is particularly important in the fast filling of compressed natural gas fuel tanks utilized as on board fuel tanks for natural gas vehicles. In this situation, it is especially beneficial to charge a fuel tank to its full mass capacity since the tank volume capacity is often limited owing to practical limitations on the available space on the vehicle. Where a vehicle tank is fast filled simply by charging it to its nominal rated pressure, the tank will, in practice, be under-filled in mass by a factor of 10 to 15% and often as much as 20%. It is known in certain applications to over-pressurize a fuel tank during refueling by some amount so that when the fuel cools to ambient temperature and the pressure drops correspondingly, it approaches a full mass charge. The general problem is exacerbated when tanks of different size and different residual pressures are presented to the filling station for refueling. There exists a need for a convenient and automatic way of determining how much over-pressurizing or other adjustment is to be made to compensate for the heating of the gas that occurs during fast filling.

There are three known causes of temperature increase in natural gas vehicle compressed natural gas containers during fast filling. 1) Adiabatic compression of all gas present in the natural gas vehicle fuel container at any given time as additional gas is admitted at incrementally higher pressures. 2) Joule-Thompson effect cooling caused by rapid pressure drop at local flow restrictions, which refrigerates the walls of fueling lines and connectors, and causes them to absorb heat from the environment. This is frequently manifested by frost build-up on the external surface of lines and connectors. When the gas comes to rest in the fuel container, the absorbed heat causes a net increase in gas temperature. 3) Thermal energy created from conversion of flow pressure drop to flow friction loss in fueling lines and connectors. All of the above appears as excess thermal energy in the gas present in the filled natural gas vehicle compressed natural gas fuel container. The first-named cause is the principal cause, and is the only one which can be readily calculated. The excess thermal energy is manifested as an increase in temperature of the gas inventory in the container, over and above the at-rest temperature in any receiver or storage vessel used to supply the gas to the fueling line. Typically dissipation of this excess thermal energy from the fuel container to the environment requires several hours, while a typical natural gas vehicle fast fill operation takes place in less than 10 minutes.

SUMMARY OF THE INVENTION

The invention provides precise remedies for the first-named cause of temperature increase as described above in natural gas vehicle compressed natural gas fuel containers (tanks) during fast filling operations. The invention provides methods and apparatus for fast filling a tank with a high pressure gas wherein compensation is automatically made for the inherent heating of the gas as described above as it is introduced to the tank. In the disclosed techniques, a proper mass charge of gas can be introduced in the filling process with the result that at equilibrium where the tank is stabilized with ambient temperature, the pressure charge is at the full nominal pressure rating of the tank.

The invention is particularly useful in a vehicle refueling station since it can determine an appropriate compensation for tanks of various size and essentially any level of residual pressure present in the vehicle's on board fuel tanks when the vehicle is presented for fueling.

In practicing a first embodiment of this invention, a supply line or hose is coupled to the vehicle tank to be filled or refilled. First, the pressure in the vehicle tank is measured by a sensor responsive to the pressure, at the hose nozzle outlet, that is required to admit gas into the tank through any check valve at its inlet port. Then, a measured mass of gas is introduced into the vehicle tank from the supply hose. The incremental increase in pressure in the vehicle tank due to the addition of the measured charge or mass is used to calculate the volume of the vehicle tank. The calculated value of volume is then utilized to establish the total mass that should reside in the vehicle tank under its nominal pressure and at a standard ambient temperature of, for instance, 70° F. (530° R.). Measurements of temperature, pressure, mass and other data are communicated to and registered in a controller that includes a microprocessor or simple computer. The computer can compute the vehicle tank volume and mass of gas to be added that will result in fully filled fuel tanks at equilibrium, and can then control the dispensing of the computed mass into the vehicle tank. Moreover, the computer can be used to control any sequencing of valves of a cascade bank of supply tanks.

In accordance with a second embodiment of the invention, the heating of the gas in the vehicle fuel tank is compensated for by supplying the refueling gas at a subambient temperature. In this manner, the heat generated in the filling process is absorbed by the refueling gas introduced into the vehicle tank in a manner calculated to result in a condition where at the end of the filling cycle the gas is raised to ambient temperature.

BRIEF DESCRIPTION OF THE DRAWINGS

FIGS. 4, 4*a*, 4*b*, 4*c*, 4*d* and 4*e*, comprise a second generalized flow chart diagram in which the process of the invention of FIG. 3 is executed.

DESCRIPTION OF THE PREFERRED EMBODIMENTS

Figure 1:
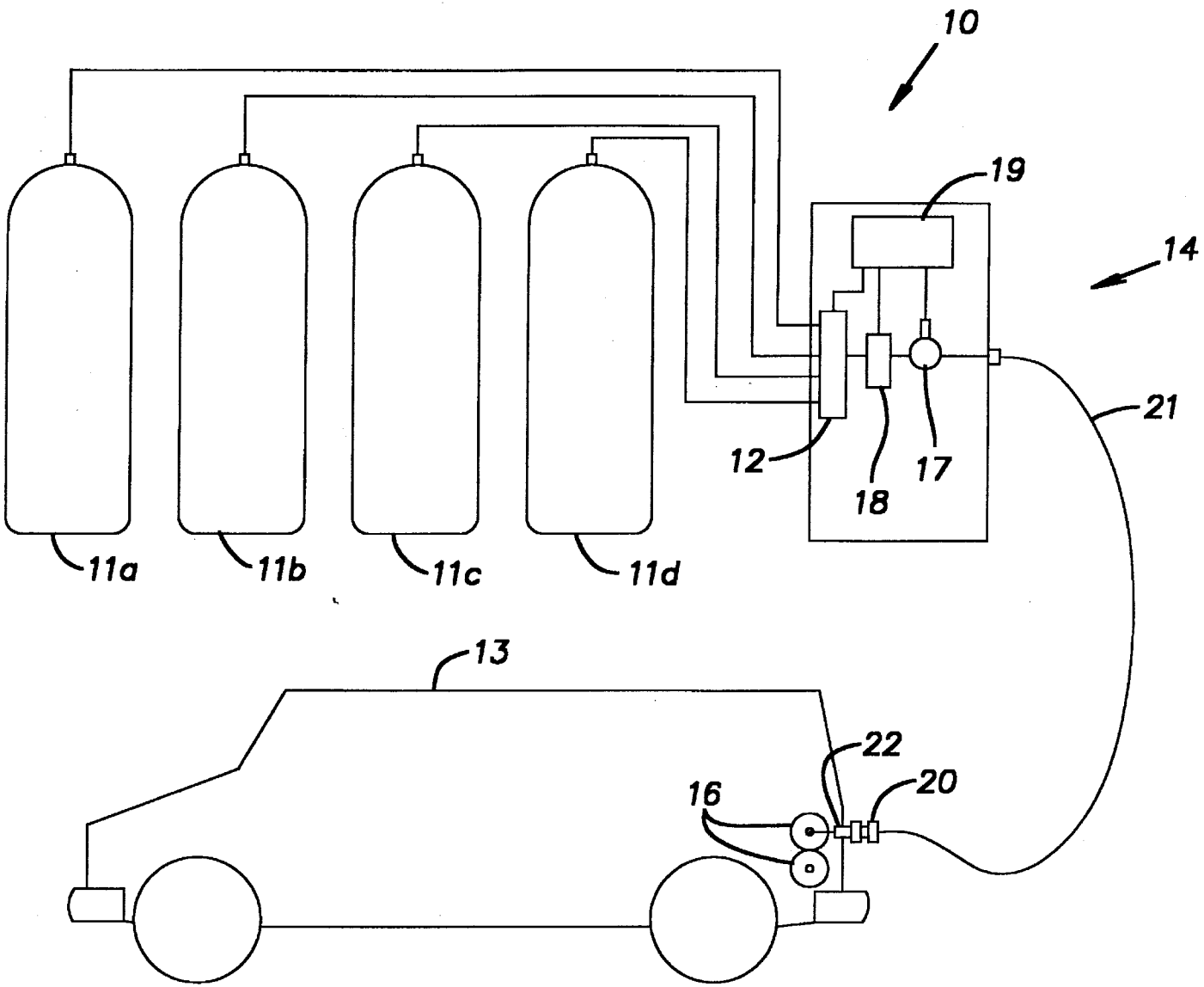
FIG. 1 is a schematic drawing of a refueling station constructed in accordance with one embodiment of the invention.
Figure 2A:
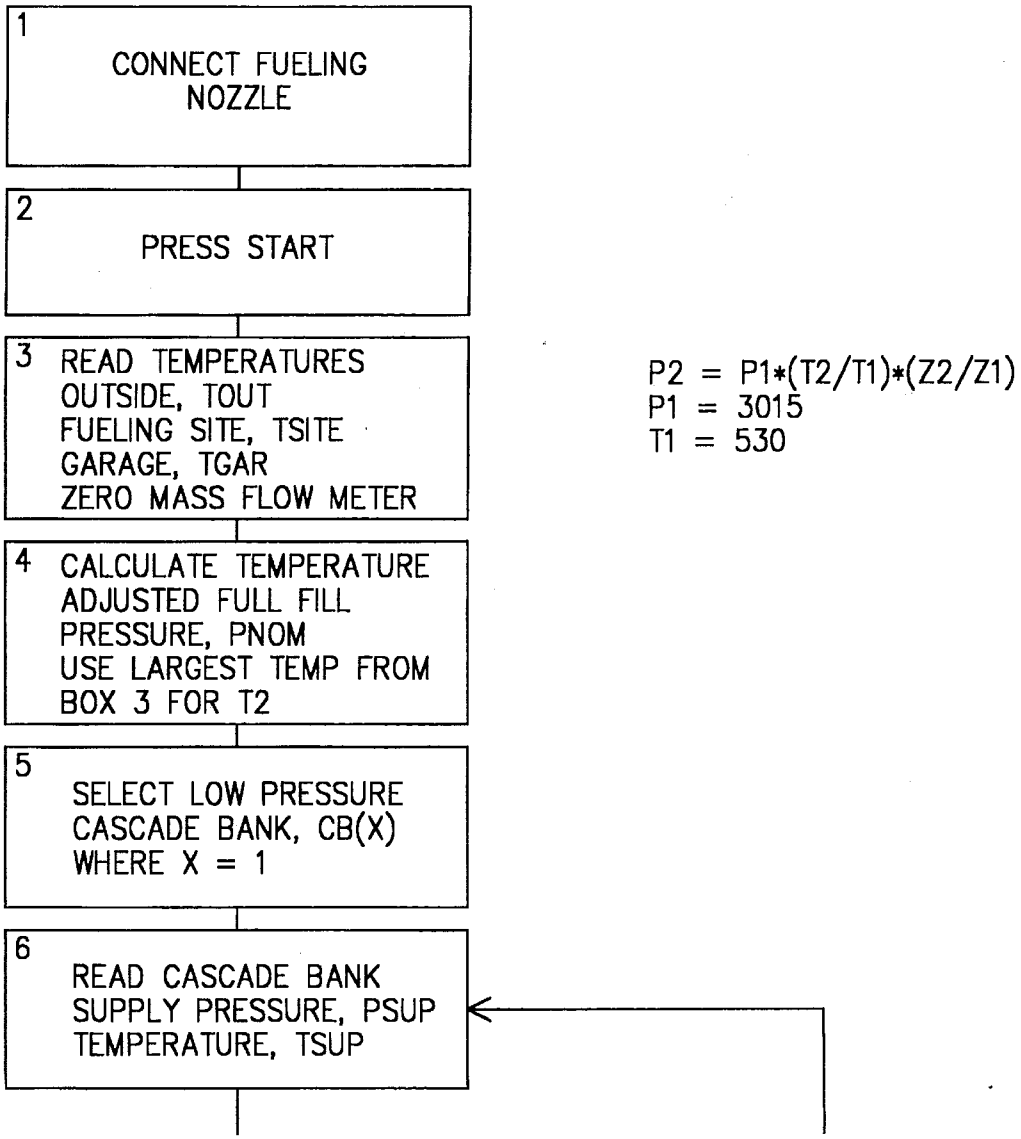
FIGS. 2*a*, 2*b*, 2*c*, 2*d*, 2*e*, 2*f* and 2*g*, illustrate a generalized flow chart diagram in which the process of the invention of FIG. 1 is executed.
Figure 2B:
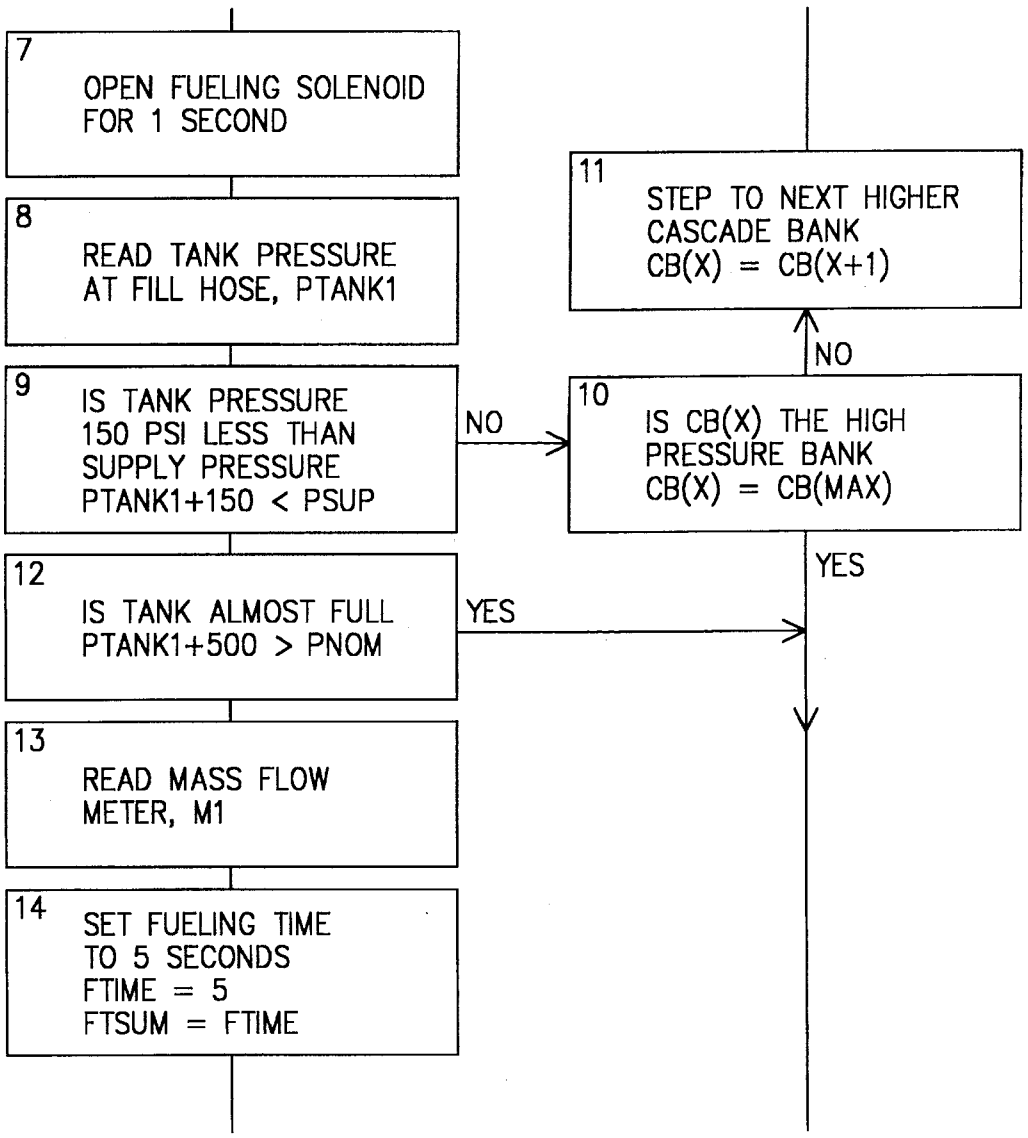
Figure 2C:
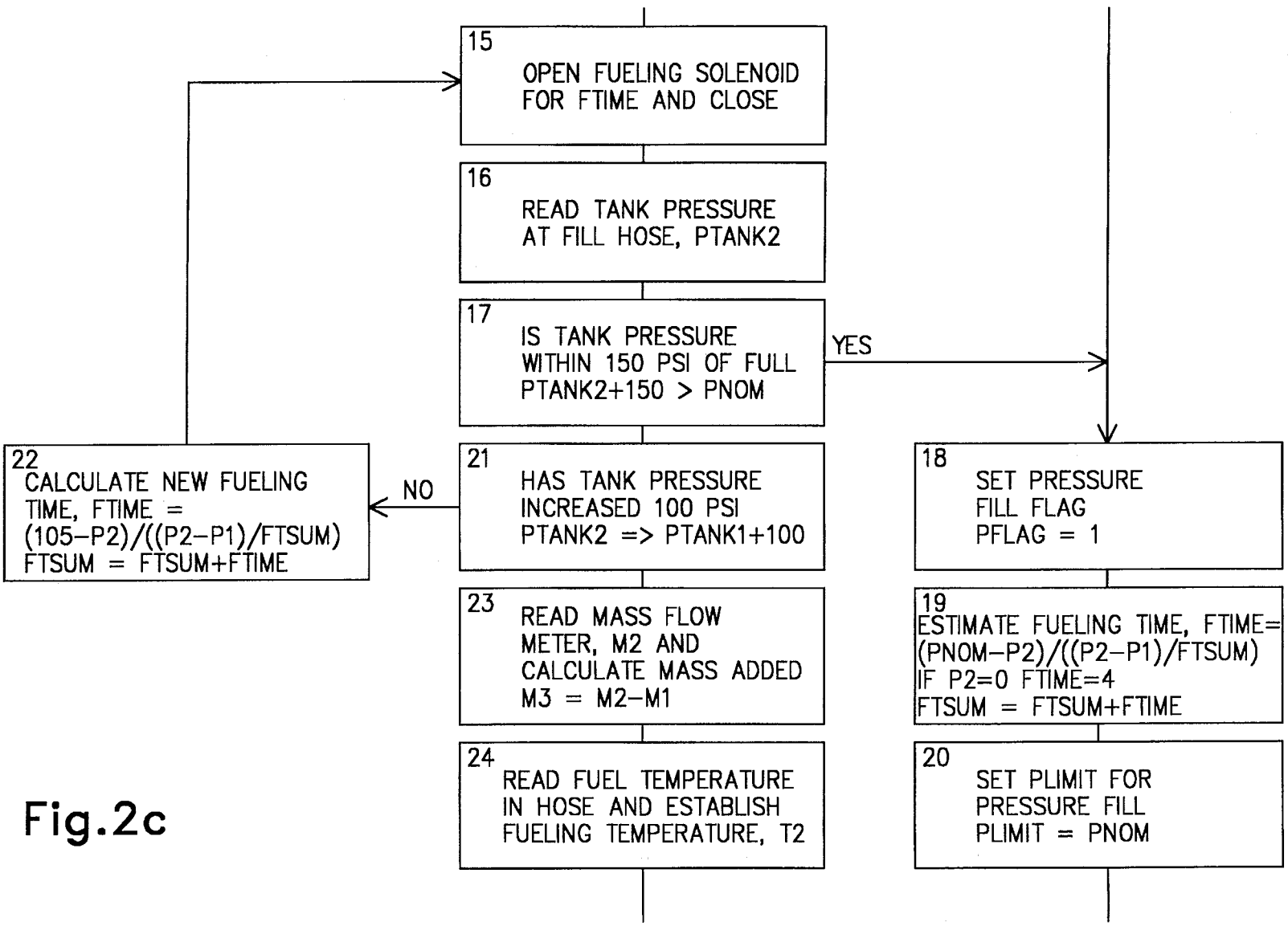
Figure 2D:
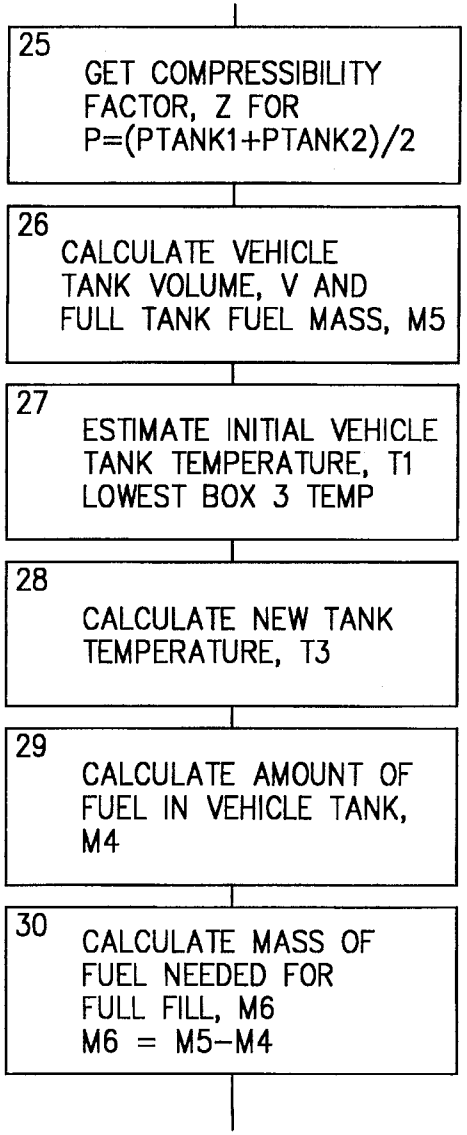
Figure 2E:
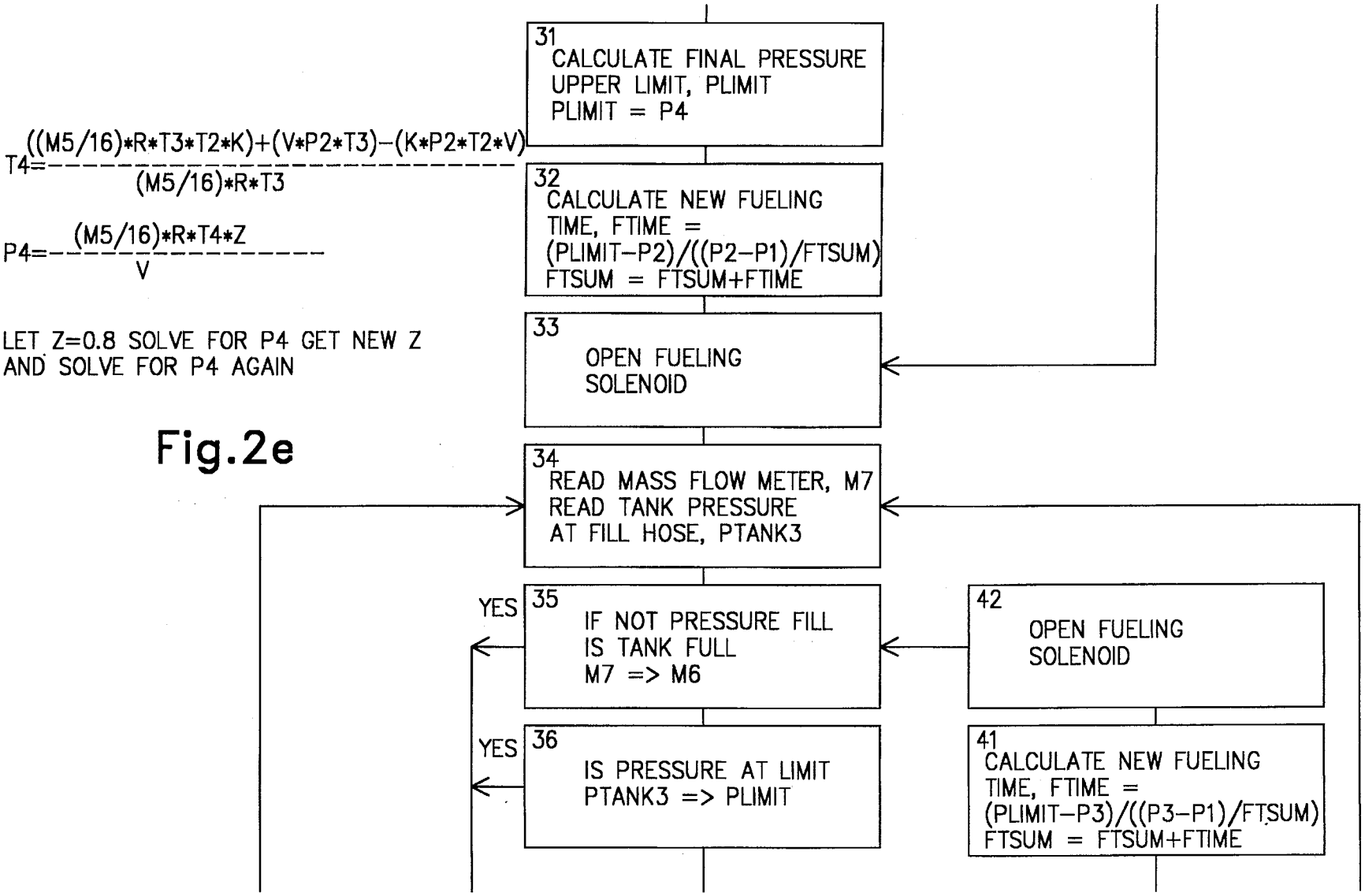
Figure 2F:
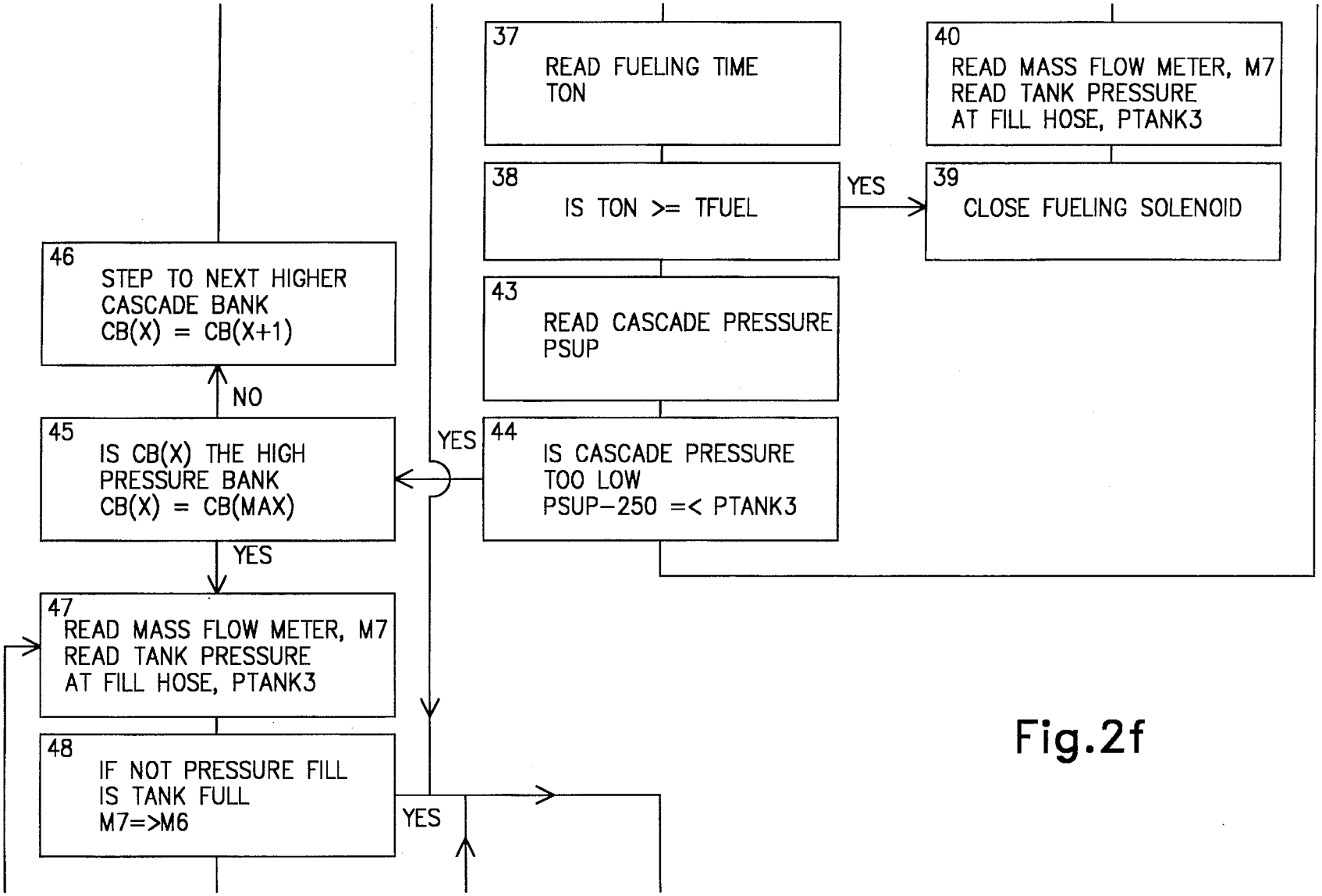
Figure 2G:
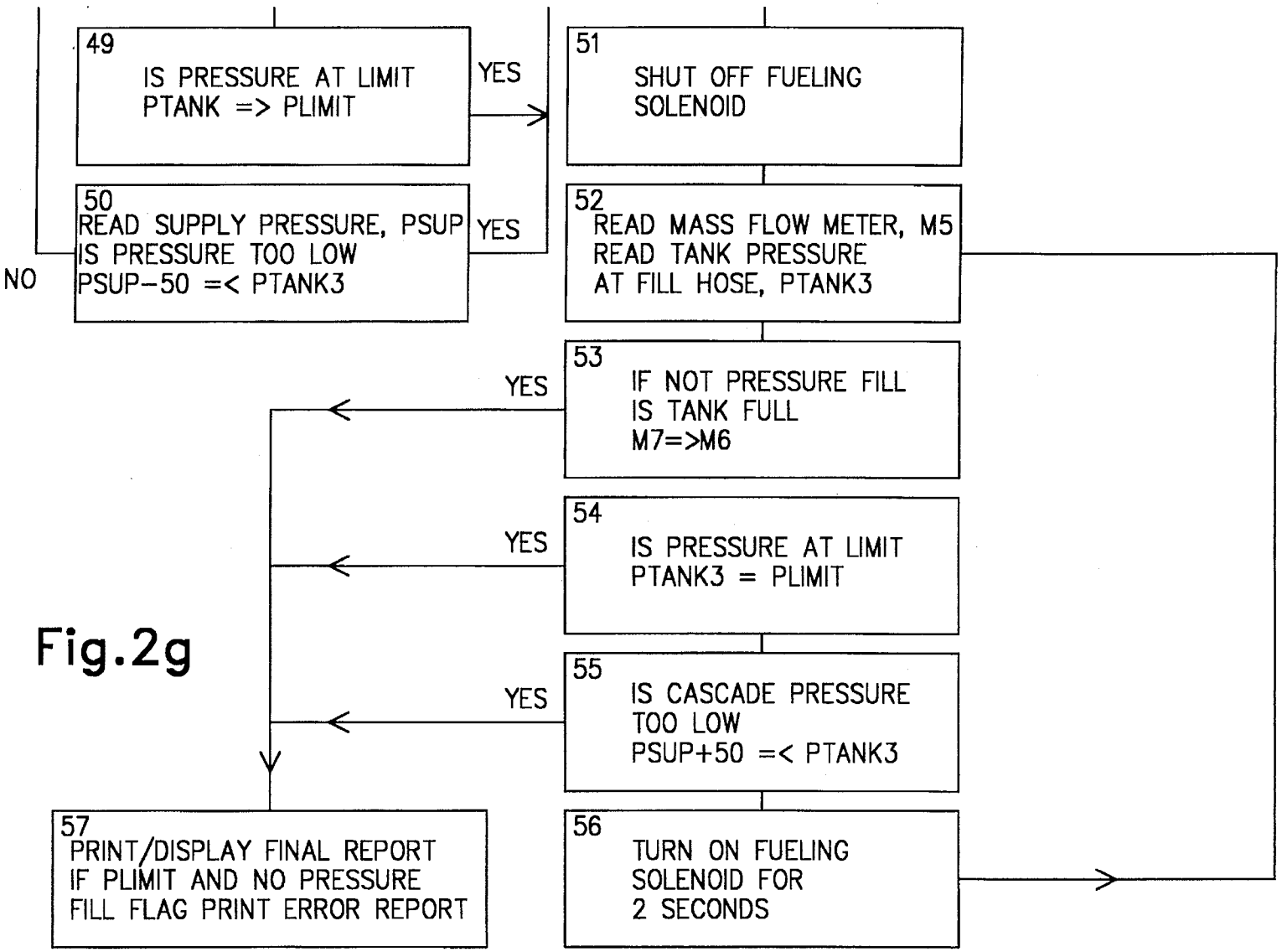

Referring to FIG. 1, there is shown a refueling station 10 for fueling road vehicles with compressed natural gas. The station includes a bank of storage supply tanks 11A through 11D containing compressed natural gas and connected in cascade fashion by an automatically controlled distribution valve 12 known in the art. The tanks 11 typically are operated at different pressure levels differing, for example, by 250 psi. In the disclosed arrangement, the vehicles being refueled, such as the vehicle shown at 13 in FIG. 1 are assumed to be fitted with a tank or tanks manifolded together in parallel that have a nominal pressure rating of 3,000 psi. It will be understood that the principles of the invention are adaptable to other tank ratings. The numeral 14 designates dispensing apparatus for supplying compressed natural gas from the supply tanks 11 to a vehicle tank 16. The apparatus 14 includes the distribution valve 12, a solenoid valve 17, a mass flow meter 18 and a controller 19 automatically operating these valves and meter. The controller 19 can take the form of a microprocessor or other small computer known in the art.

A supply line or fill hose 21 from the meter 18 has a nozzle 20 adapted to be connected to an inlet port coupling or receptacle 22 for the fuel tank 16 of the vehicle 13. The dispensing apparatus 14 preferably includes temperature sensors for measuring the outside temperature TOUT, fueling site temperature TSITE, and garage temperature TGAR. The outside temperature TOUT is the ambient outside air temperature. The fueling site temperature TSITE is that of any outside sheltered area where the apparatus 14 is situated having a temperature different than the ambient outside air temperature and the garage temperature TGAR is the temperature of any garage existing where a vehicle may be stored before being refueled. Further, the apparatus 14 includes a sensor for monitoring the temperature of fuel being delivered by the hose 21 through the nozzle 20. Also, the apparatus 14 includes a pressure sensor, for example, at the outlet of the nozzle 20, for monitoring the pressure of fuel gas in the nozzle at the coupling 22. The pressure and temperature sensors are all connected to provide appropriate signals to the controller 19.

Operation of the refueling station 10 is described with reference to the flow chart diagram of FIGS. 2*a* through 2*g*, inclusive which are to be understood as being continuous from sheet to sheet. The total vehicle fuel tank volume capacity as well as the level of depletion can vary from vehicle to vehicle. For simplicity, it is assumed that all of the vehicle fuel tanks arriving at the refueling station 10 have the same nominal pressure capacity (3,000 psi) but it will be understood by those skilled in the art that the principles of the invention are applicable to situations where the vehicles have tanks of different nominal pressure capacities such as 2,400 psi and 3,600 psi.

The invention overcomes the problem of insufficient filling of a vehicle fuel tank due to heating of the gas in the fuel tank above the supply temperature primarily from adiabatic compression of gas in the vehicle tank and from other secondary factors as noted in the Prior Art section. The FIG. 2 flow chart diagram explains the automatic operations of the controller 19 in the successive boxes and that of the other components of the apparatus 14 in recharging or refueling the fuel tank 16 of the vehicle 13.

The fueling nozzle 20 is coupled to the vehicle fuel tank 16 through the coupling 22 and a start switch is actuated. At box 3, the controller 19 performs the operations described and registers the identified temperatures discussed above where appropriate. Box 4 reflects a temperature adjustment calculation for the nominal pressure capacity of a 3,000 psi tank. The corrected pressure is given as PNOM or P2 in the formula at the right of box 4. P1 is 3,000 psi plus atmospheric pressure of 15 psi; T1 is 70° F. or 530° R.; Z1 and Z2 are compressibility factors for natural gas at P1 and P2, respectively, from known tables stored in the memory of the controller 19. P2 is estimated and can be iterated as desired.

As reflected in box 7, the solenoid valve 17, which is an on/off flow control valve, is opened for one second to pressurize the supply or fill hose 21. When the solenoid is closed at box 8, this hose pressure is read and registered. Note that the pressure sensor responsive to this pressure is connected to the feed hose and is therefore external and remote from the vehicle fuel tank. When the solenoid valve 17 closes under the proper conditions (boxes 9 and 12 lead to box 13), the pressure in the fill hose falls essentially to the pressure of the gas in the vehicle fuel tank (PTANK1).

At box 13, the controller 19 registers the mass flow of gas into the vehicle tank that was introduced at the operation of box 7. At box 15, the solenoid is opened for a predetermined period of, for example, 5 seconds and then closed. At box 16, the new pressure of the vehicle tank developed by the increased mass introduced into the tank at the operation of box 15 is read and registered. With reference to box 21, if a sufficient mass has been introduced so that the new measured vehicle tank pressure PTANK2 exceeds the original measured vehicle tank pressure PTANK1 by, for example, 100 psi, it can be assumed that reasonably accurate calculations can be made to determine the as yet unknown volume of the tank 16 of the vehicle 13. Assuming that the 100 psi increase condition is met, the operation of box 23 is performed to determine the mass added in the solenoid open operation of box 15 and the operation of box 24 is performed to establish the temperature of the supplied fuel P2 as measured by the sensor in the hose 21. In box 25, the controller 19 retrieves the compressibility factor Z from known gas data stored or inserted into memory for an average pressure of PTANK1 and PTANK2. The previously unknown volume of the vehicle tank and the corresponding full tank fuel mass can now be calculated by the controller 19 from the observed data at box 26 according to the formulas set out to the left of box 26. These formulas are simply expressions derived from the basic gas law equation PV=NRTZ.

In these equations, the factor 16 allows the gas mass to be expressed in pounds. R is the universal gas constant. P1 and P2 are PTANK1 and PTANK2, respectively. As before, the number 3,015 represents a nominal tank reading of 3,000 psi plus atmospheric pressure; 530° R. is the Rankine temperature scale value of 70° F. and Z2 is the non-ideal gas correction for natural gas at 70° F. The operation of boxes 28 and 29 follow the equations at their left.

At box 30, the mass M6 of fuel gas to be added to the vehicle fuel tank to obtain a full fill is calculated. This is the amount of gas mass that, ideally, will result in a pressure equal to the nominal design pressure capacity of the tank when the vehicle tank and the gas therein reach thermal equilibrium at a design point of for example 70° F.

Thereafter, the solenoid is opened (at box 33) and, under typical conditions, the valve is held open until the total measured mass M7 equals the mass M6 calculated to be needed for a full fill. At this point, in the simplest case, the operation can jump to box 51, box 53 and box 57 to complete a filling cycle and release the vehicle.

The foregoing discussion represents an explanation of the invention wherein the mass of gas required to obtain a complete or full fill, when the temperature of the vehicle tank and contained gas stabilizes, is calculated by pressure, temperature and mass flow measurements made external of the vehicle tank. In FIG. 2, the various loops and branches of operations represent refinements and safety measurements for augmenting the basic process.

Boxes 10 and 11 represent a cascade step-up loop executed by the controller.

Boxes 18, 19 and 20 represent a branch that sets a simple pressure fill condition typically where the vehicle tank is almost full when it is initially coupled to the nozzle.

Boxes 39 through 42 represent a recalibration loop for a fueling time update that enables a check for potential mishaps.

Boxes 45 and 46 represent a cascade sequence loop executed by the controller.

Boxes 47 through 50 represent a low relative supply pressure filling loop.

Boxes 52 through 56 represent a top-off or final fill cycle loop.

An additional safety consideration is the maximum cyclic pressure to which the vehicle fuel tank 16 has been certification tested. Under some circumstances, especially at high values of TOUT, the calculated PLIMIT will exceed the maximum cyclic pressure. For most natural gas vehicle fuel tanks presently in use, the maximum cyclic pressure is 125% of the tank's nominal pressure rating. For example, a tank with a nominal pressure rating of 3,000 psi is cycle tested to 3,750 psi during certification testing. This value can be input to the controller as an additional criteria for checking PTANK3, so that when reached, the fueling operation is terminated.

Figure 3:
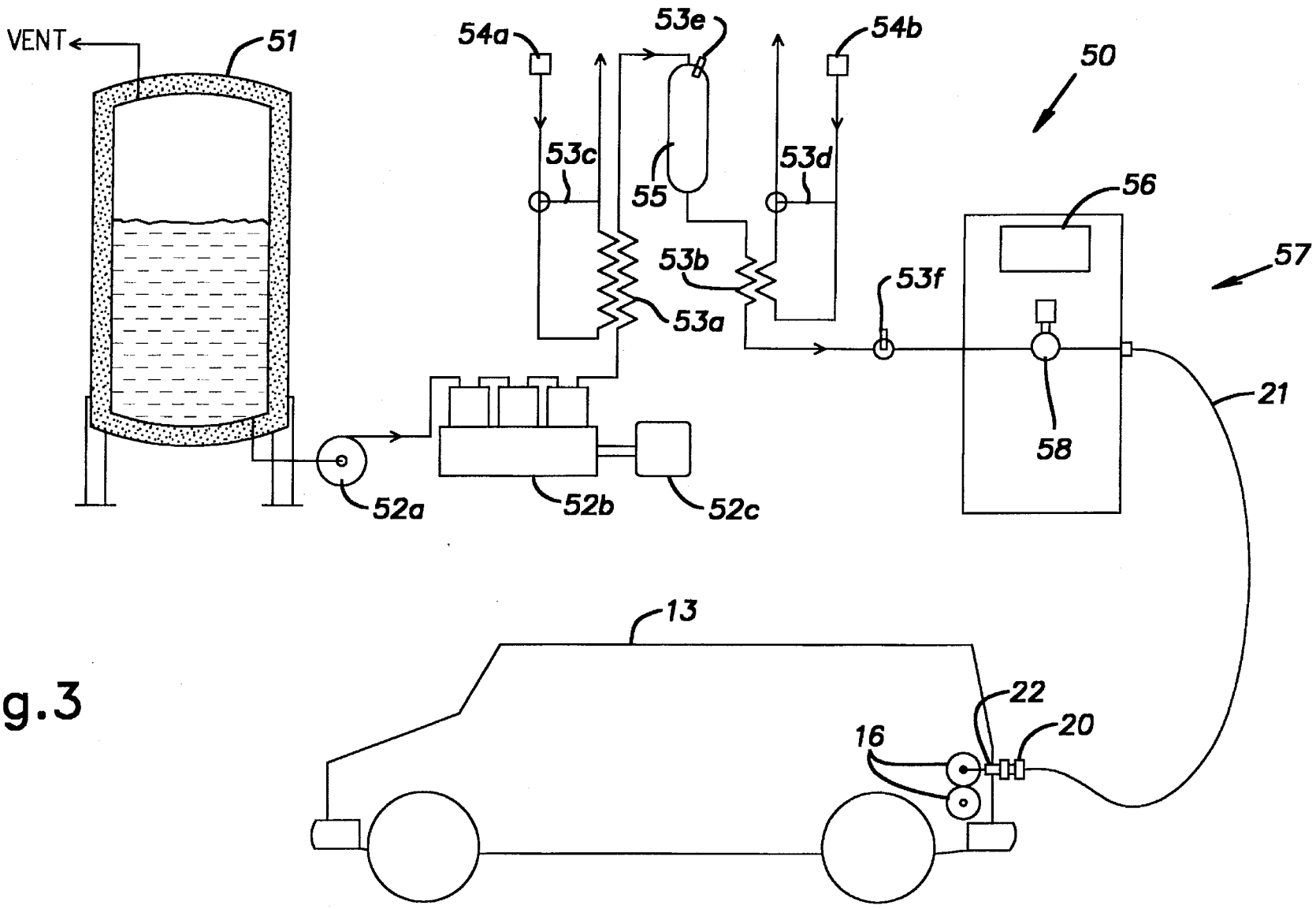
FIG. 3 is a schematic drawing of a refueling station constructed in accordance with another embodiment of the invention.
Figure 4A:
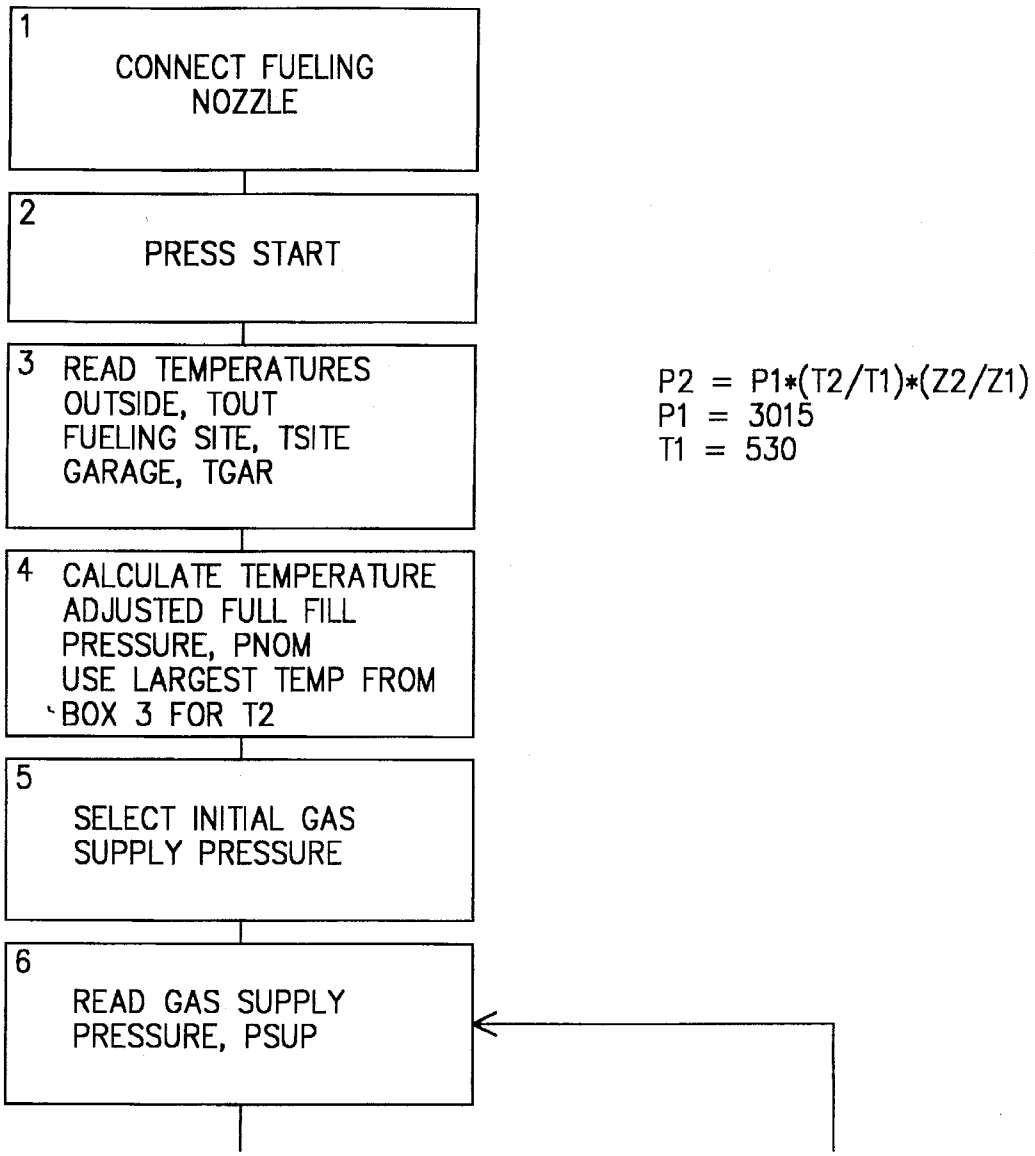
Figure 4B:
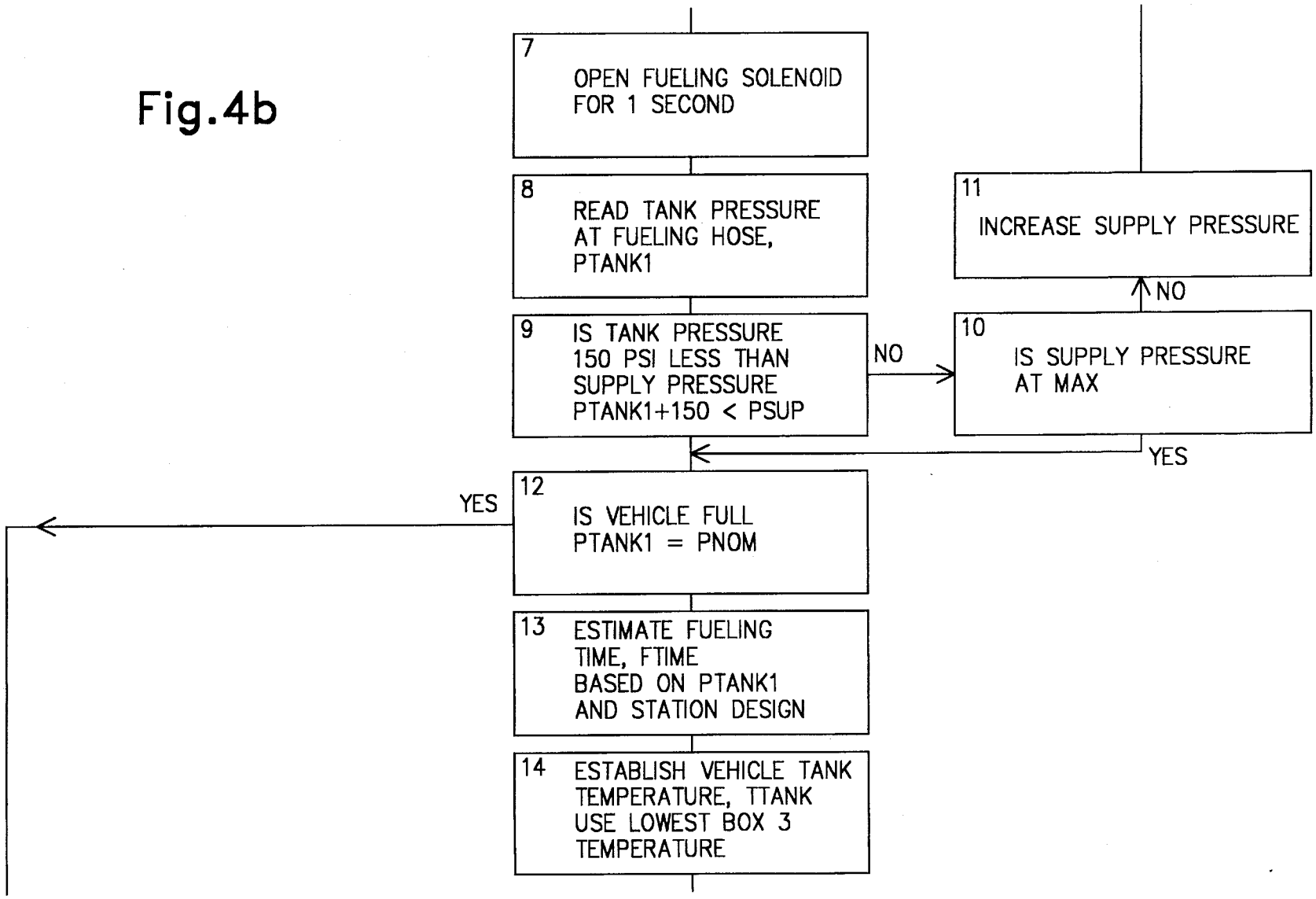
Figure 4C:
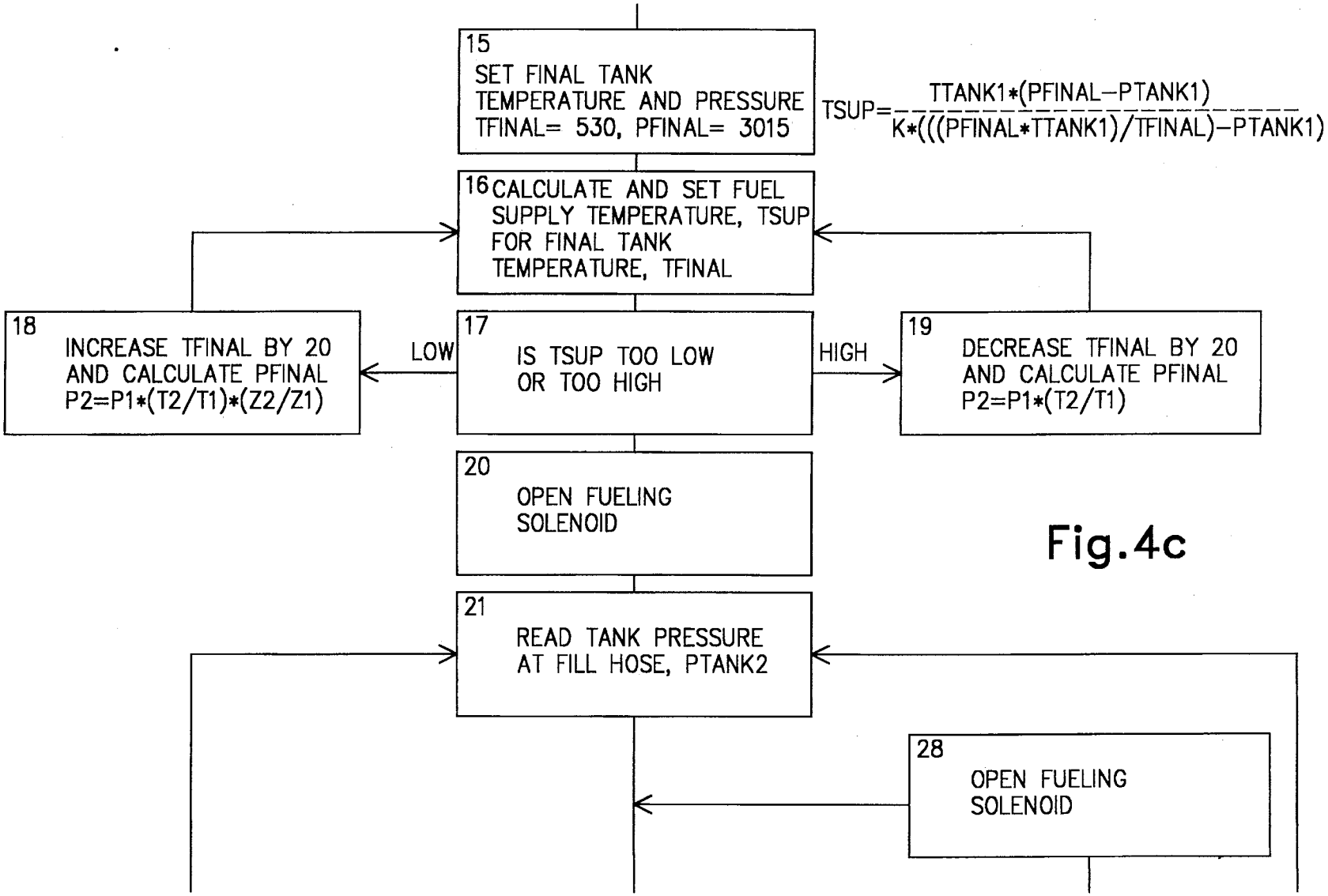
Figure 4D:
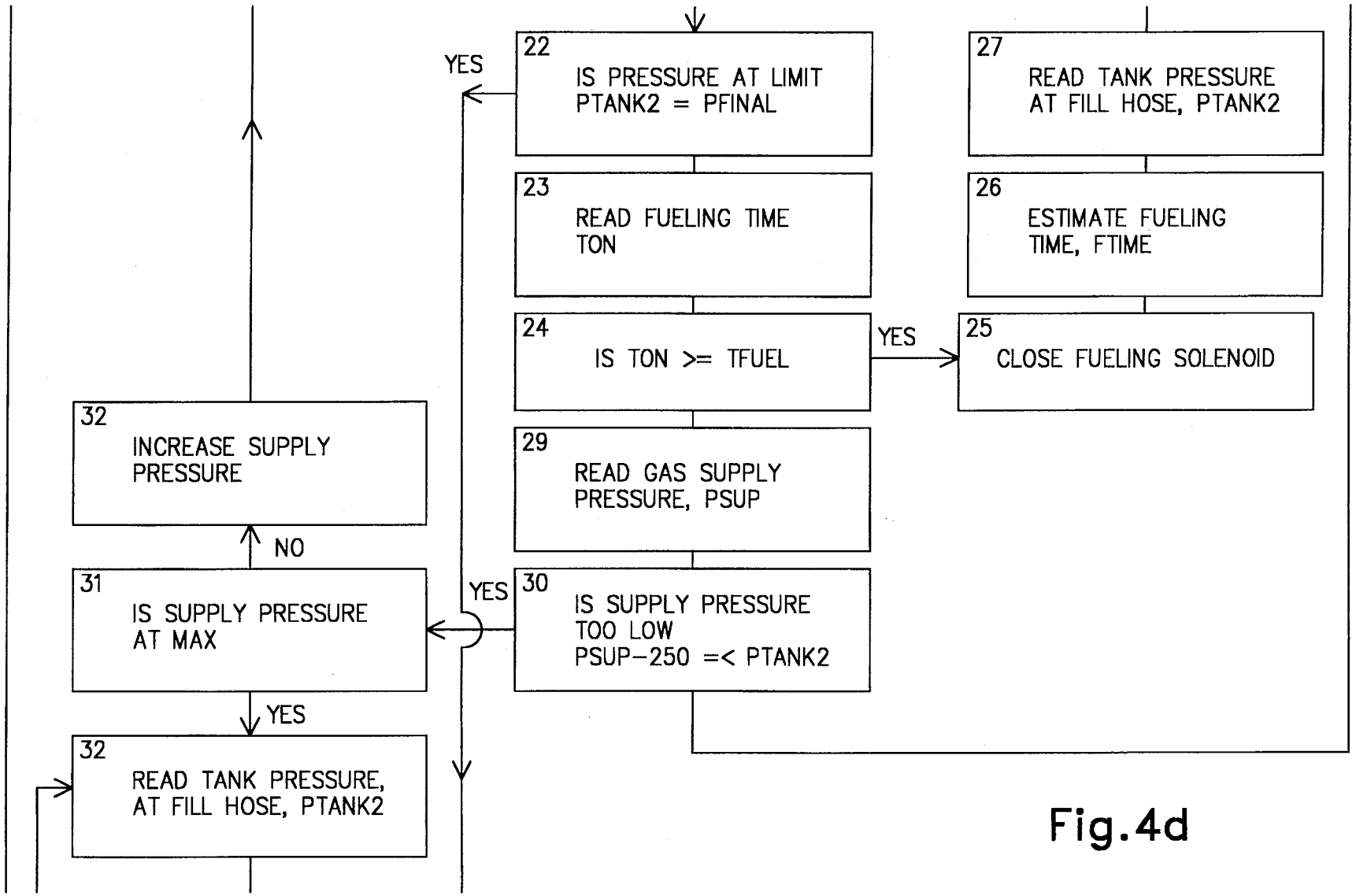
Figure 4E:
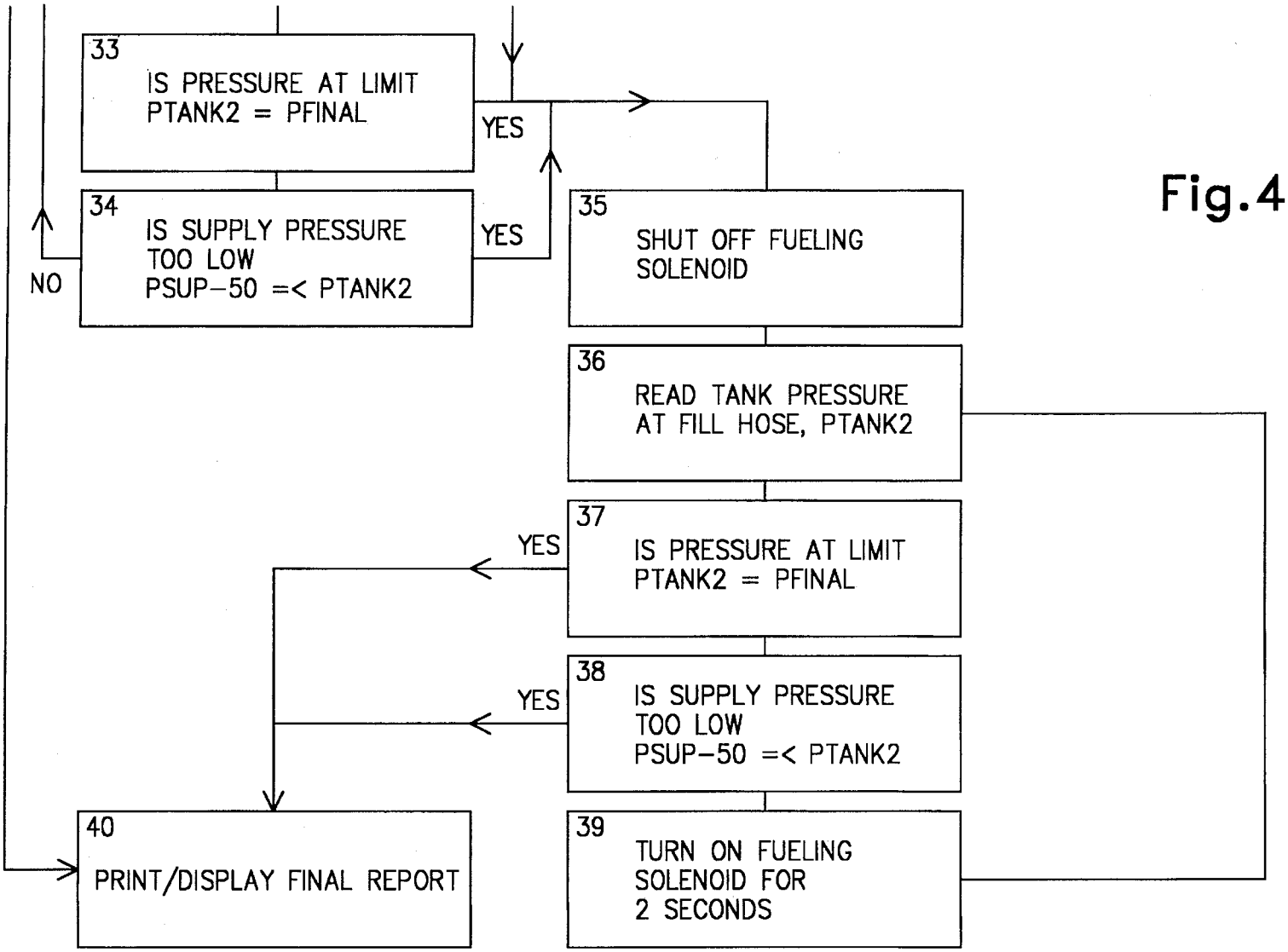

Referring now to FIG. 3, there is shown a refueling station 50 similar to the station 10 illustrated in FIG. 1 except the supply of natural gas is stored at the station as liquified natural gas (LNG). Examples of apparatus and methods of converting LNG to high pressure compressed natural gas vapor are set forth in U.S. Pat. No. 5,107,906 to Swenson et al. the disclosure of which is incorporated herein by reference. The LNG is stored in an insulated tank 51 from which it is moved on demand by a pump 52 through a vaporizer 53. The pump 52 is preferably divided into two sections, **52*a* and 52*b*, where 52*a* is a low pressure rise priming pump and 52*b* is a high pressure rise pump, typically three stages, which is driven by a variable speed motor 52*c* which is controlled by a controller 56 more fully described below for the purpose of regulating the pressure of the vaporized gas, delivered to a dispensing apparatus 57, to the desired supply pressure (PSUP). The vaporizer 53 includes a source of heat, diagrammatically indicated at 54, such as ambient air, ground water, or a combustor of natural gas. The amount of heat supplied to the vaporizer is regulated by the controller 56** so as to supply natural gas vapor at a desired temperature as discussed more fully below.

The vaporizer 53 is preferably divided into two sections, **53*a* and 53*b*, each with associated heat sources 54*a* and 54*b*. Vaporizer section 53*a* is now a primary vaporizer and 53*b* is now a tempering heat exchanger that tempers the vaporized gas delivered to the dispenser apparatus 57 to the desired supply temperature (TSUP), in a manner similar to the two step vaporizing method set forth in U.S. Pat. No. 5,107,906 cited above. Preferably, a receiver 55 is positioned between the primary vaporizer 53*a* and the tempering heat exchanger 53*b* for the purpose of averaging any temperature fluctuations induced in the gas in the primary vaporizer 53*a*, and also for the purpose of storing a relatively large volume of vaporized but untempered gas at PSUP, such that one or more vehicles 13 can be fueled on demand without restarting pump 52** for each fueling occurrence.

The amount of heat supplied to the vaporizer **53*a* can be conveniently controlled by the controller 56 by means of a heat source bypass circuit 53*c*, and likewise for the tempering heat exchanger 53*b* by a heat source bypass circuit 53*d*. The purpose of controlling heat source bypass circuit 53*c* is to maintain the temperature of the untempered gas delivered to the receiver 55 as sensed by sensor 53*e*, within a range compatible with the limited capacity of the tempering heat exchanger 53*b* to deliver gas to the dispenser 57 (described below) at the desired temperature TSUP. The heat source bypass circuit 53*d* is controlled to ensure that the temperature of gas delivered to the dispenser 57, as sensed by sensor 53*f***, is the desired temperature TSUP.

In the case where ambient air or some other naturally occurring heat source is used as heat source **54*a*, however, control of that heat source may be difficult or impractical. In the general case for a naturally occurring heat source, the temperature of the vaporized gas delivered to receiver 55 as measured by sensor 53*e*, may be either lower or higher than the desired temperature TSUP. Therefore, the tempering heat exchanger 53*b* may in some instances, be called upon to remove heat from the vaporized but untempered gas contained in receiver 55. This will also be the case when untempered gas is stored for a long period of time in receiver 55 and thereby warmed by heat transferred through the walls of receiver 55** to local ambient temperature (TOUT) which will usually be higher than the desired temperature TSUP, as determined by the method explained below.

In those instances where the tempering heat exchanger **53*b* is called upon to remove heat from the untempered gas flowing from receiver 55 heat source 54*b* becomes a heat sink colder than TSUP, and supplies refrigeration to tempering heat exchanger 53*b*. The LNG storage tank 51** is an example of a heat sink colder than TSUP.

The refueling station 50 includes the dispensing apparatus 57 for supplying high pressure compressed natural gas from the vaporizer or source 53 to a vehicle 13 through a fill or fueling hose 21. The vehicle 13 and fueling hose or line 21 are like that described in connection with FIG. 1.

The dispenser apparatus 57 includes the controller 56 in the form of a microprocessor or small computer which in addition to performing the control functions for the pump 52 and vaporizer 53 described above, receives signals from sensors at the site to monitor the outside air temperature (TOUT), the air temperature of the site (TSITE) and the garage temperature (TGAR)in the manner of the controller 19 of FIG. 1. The controller 56 communicates with a sensor that measures the pressure (PSUP) and the sensor **53*f* that measures the temperature (TSUP) of the gas being supplied from the outlet of the supply vaporizer 53. In the illustrated case, the pressure of the supply vaporizer is determined by the pressure output of the pump 52 which is controlled by the controller 56 as described above. The controller 56 operates to automatically open and close a solenoid flow control valve 58 to selectively connect the gas supply vaporizer 53 to the fueling hose 21. Additionally, the controller 56 communicates with a pressure sensor responsive to the pressure in the fueling hose 21 which in the flow chart of FIG. 4** at appropriate times represents the values PTANK1 and PTANK2.

With reference to FIGS. **4*a* through 4*e*, there is shown a continuous flow chart diagram that depicts the operations of the controller 56 and other components Of the dispensing apparatus 57 to refuel the vehicle 13. The operations of boxes 1 through 4 are as described above in connection with FIG. 2. With reference to box 5, the controller 56 selects an initial gas supply pressure (PSUP) of, for example, 1,000 psi and signals the pump 52 to produce the same. At box 7, the solenoid valve 58 is opened by the controller 56 for one second, for example, to pressurize the fueling hose 21 such that the check valve associated with coupler 22 opens. As before described in connection with FIGS. 1 and 2, this step, following closing of the solenoid valve 58 and assuming the supply pressure (PSUP) is sufficiently high, allows the pressure in the fueling hose (PTANK1) to assume the pressure of the vehicle tank, less any difference resulting from flow pressure drop across the check valve or the like at the inlet port or coupler 22** which difference is assumed to be negligible.

At box 13, an initial estimated fueling time is assigned based on experience and can be in the order of a period of two or three minutes.

Box 14 reflects the operation of the controller 56 in establishing or assigning a temperature (TTANK) of the vehicle tank 16 by selecting the lowest value of temperature from box 14. The lowest temperature is selected as a matter of safety inasmuch as this results in a maximum estimate by the controller 56 of the residual inventory of fuel in the tank(s) 16 of the vehicle presented for fueling.

At box 15, the controller 56 sets a desired final tank temperature (TFINAL) of, for example, 70° F. or 530° R. and a tank pressure (PFINAL) of, for example, 3,015 psi. These values correspond to typical rating values for vehicle pressure fuel tanks presently commercially used.

In the next operation, represented by box 16, the controller 56 calculates and registers the temperature (TSUP) at which the gas is to be supplied to the vehicle tank 16 from the vaporizer supply source 53. The algorithm employed by controller 56 for computation of the desired supply temperature (TSUP) corresponds to a formula based on known thermodynamic principles. The formula is set out in FIG. 4 to the right of box 16. The formula is derived from a known formula published, for example, by Ingersoll-Rand in a handbook entitled "Compressed Air and Gas Data", 3rd edition, as equation 5.7 at page 5—5. The formula for TSUP depends on the initial vehicle tank pressure (PTANK1) referenced in box 8, the initial temperature of the vehicle tank (TTANK1) referenced in box 14, the final vehicle tank pressure (PFINAL) set, for example, at 3,015 psi for a nominal 3,000 psi rated tank and a final temperature of the tank (TFINAL) set, for example, at 70° F. or 530° R., both of the values being indicated in box 15.

The calculated value of TSUP is sufficiently low to compensate for the heat of compression of gas in the vehicle tank which is described above with the result that when the filling operation is complete, the tank will substantially be filled with compressed natural gas at the nominal rating of the tank, in this instance, 3,000 psi at 70° F.

In ordinary circumstances, the controller 56, after calculating TSUP opens the fueling solenoid valves 58 at box 20 and reads the tank pressure at the fill hose (PTANK2) at box 21. During this ensuing vehicle tank filling process, the controller 56 regulates the heat source 54 to maintain the temperature of the gas being fed to the vehicle at the calculated TSUP. When the controller 56 determines the measured tank pressure PTANK2 to be equal to PFINAL (at box 22) it shuts off the fueling solenoid valve 58 (box 35) and in the simplest case, reaffirms the equality of these pressures (at box 37) whereupon the filling operation is completed (by passage to the operation of box 40).

Boxes 10 and 11 represent a supply pressure control loop which the controller 56 executes to increase the supply pressure as necessary. This can be accomplished by a signal to the pump motor 52*c*, for example, as described above.

The check of box 17 can be performed to assure that the temperature values assigned to the temperature TSUP of the supply gas remains at practical limits for the ambient conditions. Practicality will be determined by the fuel tank's capability to endure the thermal transition represented by the difference in TSUP and TOUT.

The control loop of boxes 25 through 28 provides a fill time check to reduce the risk of a mishap due to over filling.

Boxes 31 and 32 represent a control supply pressure loop performed by the controller.

Boxes 36 to 39 form a top off loop for assuring that the tank is substantially completely filled with a measured pressure PTANK2 measured by the sensor in the filling hose 21 equal to the calculated desired PFINAL.

In the apparatus and processes of both FIGS. 1 and 2 and FIGS. 3 and 4, it is assumed that the principle heating effect on the gas contained in the vehicle fuel tank is that from adiabatic heating of the gas in the tank from compression. Other effects such as the Joule-Thompson effect and frictional flow can be calculated or measured empirically to improve the accuracy of the compensation in either the calculated and measured mass charge technique of FIGS. 1 and 2 or the temperature suppression technique of FIGS. 3 and 4.

In accordance with a third embodiment of the invention, the heating of the gas in the vehicle fuel tank is compensated for by supplying the refueling gas at a subambient temperature and furthermore the accuracy of the compensation is corroborated by a mass flow meter.

The calculation of the correct gas supply temperature as taught in the description of the second embodiment above ignores three second order heat transfer effects.

1. Heat liberated to the environment by the vehicle fuel tank during the fueling process due to its inventory of gas being heated above local ambient temperature by compression as a result of gas being added at increasingly higher pressures.

2. Heat absorbed by the gasolines and connectors when they are in a colder than ambient condition as a result of the Joule- Thompson effect cooling at flow restrictions which cause acceleration of gas flow.

3. Heating of gas flowing through lines and connectors due to conversion of flow friction loss induced pressure drop to thermal energy.

During most natural gas fast fill operations, the net loss of heat as described in second order heat transfer effect No. 1, which reduces the heating effect, dominates over effects No. 2 and 3, both of which tend to add to the heating effect. There is, therefore, in the general application of the second embodiment described above, a potential for error in the automated calculation of the correct supply temperature (TSUP). The extent of this error will be a function of the specific mechanical design features incorporated in a given natural gas vehicle fueling facility.

This third embodiment of the invention involves the incorporation of a mass flow meter's output as corroboration of the correctness of the fuel inventory as specified by TSUP and PFINAL (according to the second embodiment disclosed above). A practical method of improving the second embodiment is thus to accept the mass flow meter's prediction of a full fill as described in the first embodiment and apply it as a check on fueling under embodiment No. 2.

In the instance of this third embodiment, for purposes of explanation, the controller of FIG. 3 is programmed to execute the steps of FIG. 4 including that to calculate a desired fuel supply temperature TSUP. The controller is also programmed to execute the relevant steps of FIG. 2 to calculate the mass of gas to be added (box 30 and the preceding operations). The controller executes a further step corresponding to step 35 of FIG. 2 terminating the filling process when sufficient mass has been added to meet the calculated value if this condition is met before PTANK2= PFINAL (box 22 or 37 of FIG. 4).

The second embodiment presupposes a supply of refrigerated gas relative to the local environment, either deliberately refrigerated for the purposes of the second embodiment temperature compensation or because it had been delivered to the fueling station site as liquid natural gas (LNG). In the case where the gas had been delivered to a fueling site as LNG, a greater temperature compensation effect of using gas at a temperature below the calculated correct supply temperature TSUP of the second embodiment can be employed. In this case, a margin of compensation can be applied without economic penalty. Typically, this margin would not necessarily be more than 30° F. below the TSUP calculated in the second embodiment.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

We claim:

1. A method of fast filling a vehicle fuel tank with high pressure natural gas comprising the steps of coupling a fill line to the vehicle tank, introducing high pressure natural gas into the line and the tank, measuring the pressure in the line in a manner that yields a measurement of the initial pressure of the gas in the tank, assigning an initial temperature for the gas in the tank, predetermining the final desired pressure and temperature of the gas in the tank at the end of the fill, calculating the temperature of the gas to be added to the tank so that the adiabatic compression and rise in temperature of gas in the tank is automatically compensated for and the tank is substantially filled with a mass that results in a condition, when the tank and the gas contained therein are substantially at ambient temperature, wherein the pressure in the tank is substantially equal to the nominal rated pressure of the tank and, thereafter filling the tank with gas at the calculated gas temperature, the gas being added to the tank being supplied from a store of LNG at the site at which vehicles are being fast filled, and the gas being added to the tank being supplied at a temperature below ambient temperature in such a manner that at the end of the filling process the temperature of the gas in the tank is not substantially above ambient temperature.

2. A method as set forth in claim 1, wherein a calculation of the mass of gas to be added to the tank is made on the basis of the measurement of the initial pressure in the tank and an estimate of the volume of the tank, based on a measured subsequent increase in pressure in the tank resulting from an introduction of a limited measured mass of gas into the tank, thereafter measuring the mass of gas being introduced into the tank and discontinuing the filling operation when the measured mass of gas being introduced into the tank reaches the calculated mass.

3. A method of fast-filling a vehicle fuel tank with high pressure natural gas comprising the steps of coupling a fill line to the vehicle tank, measuring the pressure in the tank, assigning an initial temperature for the gas in the tank, predetermining the final desired pressure and temperature of the gas in the tank at the end of the fill, determining the temperature of the gas to be added to the tank so that the adiabatic compression and rise in temperature of gas in the tank is automatically compensated for, and when the determined temperature is below ambient temperature supplying high pressure natural gas to the tank at sub-ambient temperature from a supply whereby at the end of the filling process the temperature of the gas in the tank is not substantially higher than ambient temperature.

* * * * *